US005740735A

United States Patent [19]

Xydias et al.

[11] Patent Number: 5,740,735

[45] Date of Patent: Apr. 21, 1998

[54] APPARATUS FOR SECURING A SURFACE

[75] Inventors: Jean Xydias, Pittsford; John Philip Roesser, Webster, both of N.Y.

[73] Assignee: Eastman Kodak Company, Rochester, N.Y.

[21] Appl. No.: 595,682

[22] Filed: Feb. 2, 1996

[51] Int. Cl.[6] ..... B41F 9/10

[52] U.S. Cl. ..... 101/169

[58] Field of Search ..... 101/156, 157, 101/169, 207, 365, 350.1, 350.6, 363; 118/261

[56] References Cited

U.S. PATENT DOCUMENTS

| | | | |
|---|---|---|---|
| 2,068,839 | 1/1937 | Behringer . | |
| 2,148,455 | 2/1939 | Golber et al. . | |
| 2,151,968 | 3/1939 | Henderson . | |
| 2,187,421 | 1/1940 | George . | |
| 2,523,643 | 9/1950 | Bennison . | |
| 2,688,919 | 9/1954 | Kaiser . | |
| 2,768,579 | 10/1956 | Fies | 101/415.1 |
| 3,017,828 | 1/1962 | Behringer | 101/157 |
| 3,783,781 | 1/1974 | Grommek . | |
| 3,981,238 | 9/1976 | Dini . | |
| 5,562,036 | 10/1996 | Barrois et al. | 101/415.1 X |

*Primary Examiner*—J. Reed Fisher
*Attorney, Agent, or Firm*—Clyde E. Bailey, Sr.

[57] ABSTRACT

An apparatus for precisely locating and instantaneously securing and releasing a first, stationary surface in proximate contact with a second, movable surface. A portion of the first surface is compressively secured by the apparatus so as to expose a lateral edge of the first surface for contacting the second surface. Means for securing and releasing the first surface is provided to enable a quick and easy adjustment or removal of the first or second surface.

9 Claims, 4 Drawing Sheets

APPARATUS FOR SECURING A SURFACE

TECHNICAL FIELD

The present invention relates generally to securing surfaces. More particularly, the invention is concerned with an apparatus, in a gravure printing machine, for alternately firmly securing and releasing a doctor blade in proximate contact with a moving surface for repeated uniform and efficient removal of residual printing material, such as ink, from the moving surface.

BACKGROUND OF THE INVENTION

In a typical gravure printing machine, a printing material, such as ink, is supplied to a generally cylindrical roller which then transfers the ink to a product surface. During this process, residual ink is routinely removed from the roller so as to avoid blotching and unwanted spotting of the ink onto the product surface. Conventional gravure printing machines use a doctor blade for wiping the roller of residual printing material. Prior art doctor blades in gravure printing environments are configured to contact the surface of the ink transfer roller for removing a residual layer of ink therefrom. The roller is occasionally removed from the machine to accomodate a new print task, such as the printing of new labels on photographic web, by first releasing the blade in contact therewith and then backing it away from the roller. To do so requires the blade to be released and either urged away so as to provide clearance for the roller removal or simply removed from the machine. When the roller is reinstalled, the blade is then located, aligned and secured in proximate contact with the roller.

One problem with the present practice is that when the blade requires adjusting it is often difficult to align the blade so that a lateral edge will repeatedly uniformly contact a circumferential portion of the product roller. This is because the process for adjusting and securing the wiper blade, of the type heretofore described, involves independently adjusting (i.e., locking and releasing) the securing means (or typically clamps) at several locations (typically more than about 4) along the doctor blade until the lateral edge of the blade extends substantially evenly across the surface of the ink transfer roller. These series of independent locking and releasing clamp adjustments almost invariably assures that the extending lateral edge of the blade will not repeatedly align uniformly with a circumferential portion of the ink transfer roller surface. Thus, frequent blade adjustments coupled with inefficient removal of residual ink from the roller surface correspond to production downtime and unacceptable printing quality. Moreover, with a large number of print machines running at one time, the enormous downtime required to periodically adjust each clamp on each blade results in an inefficient production operation.

Some prior art attempts to address one or more of the above problems include U.S. Pat. No. 5,069,125, U.S. Pat. No. 2,688,919, U.S. Pat. No. 2,187,421, U.S. Pat. No. 2,148,455, U.S. Pat. No. 3,783,781, and U.S. Pat. No. 3,981,238. Each of these references teaches generally a plurality of independent clamps for securing a doctor blade. Thus, each of the clamps must be individually adjusted to release and secure the blade. Typical of the independent clamps used on prior art doctor blades is the arrangement illustrated in FIG. 1. The plurality of clamps 1 that secure the blade (2) must be independently adjusted to either secure or release the blade (2).

Therefore, a need persists for an apparatus that enables an easy and instantaneous securing and releasing of a doctor blade in proximate contact with a moving surface so that the doctor blade, when removed or repositioned, can be repeatedly precisely aligned in proximate contact with the moving surface.

SUMMARY OF THE INVENTION

It is, therefore, an object of the present invention to provide an apparatus for securing a doctor blade in proximate contact with another surface that is capable of repeated uniform alignment with the surface.

It is a feature of the invention that a series of interdependent clamp members are provided which can instantaneously and uniformly open to release or receive a portion of the blade surface and then instantaneously close to secure the blade surface in precise alignment and proximate contact with a moving surface.

It is an advantage of the present invention that printing machine downtime is significantly decreased because adjustment, either removal or repositioning, of the doctor blade can be accomplished by an instantanteous adjustment of the clamp member.

To achieve this and other objects and advantages of the invention, there is provided, in one aspect of the invention, an apparatus for precisely locating and securing a first, stationary surface into proximate contact with a second, moving surface, comprises a frame for supporting the first surface. Additionally, means associated with said frame are provided for compressively holding at least a portion of the first surface so as to expose an edge thereof. The compressive means exert a constant and uniform force substantially lengthwise along an outward face of at least a portion of the blade. Further, in this embodiment, means for opening and then closing the compressive means is provided so as to alternately receive and release the portion of the first surface.

In another aspect of the invention, a method of securing and aligning a first, fixed surface in proximate relations with a second, moving surface, comprises the steps of providing a first surface and a means for compressively holding the first surface in alignment with the second surface. Further, the method includes the step of compressively engaging at least a portion of the first surface so as to expose a lateral edge thereof. In this embodiment, the engaging means further secures the location of the first surface in relations to the second surface.

BRIEF DESCRIPTION OF THE DRAWINGS

The foregoing and other objectives, features and advantages of the invention will be apparent from the following more particular of the preferred embodiments of the invention, as illustrated in the accompanying drawings.

DETAILED DESCRIPTION OF THE DRAWINGS

Figure 1:
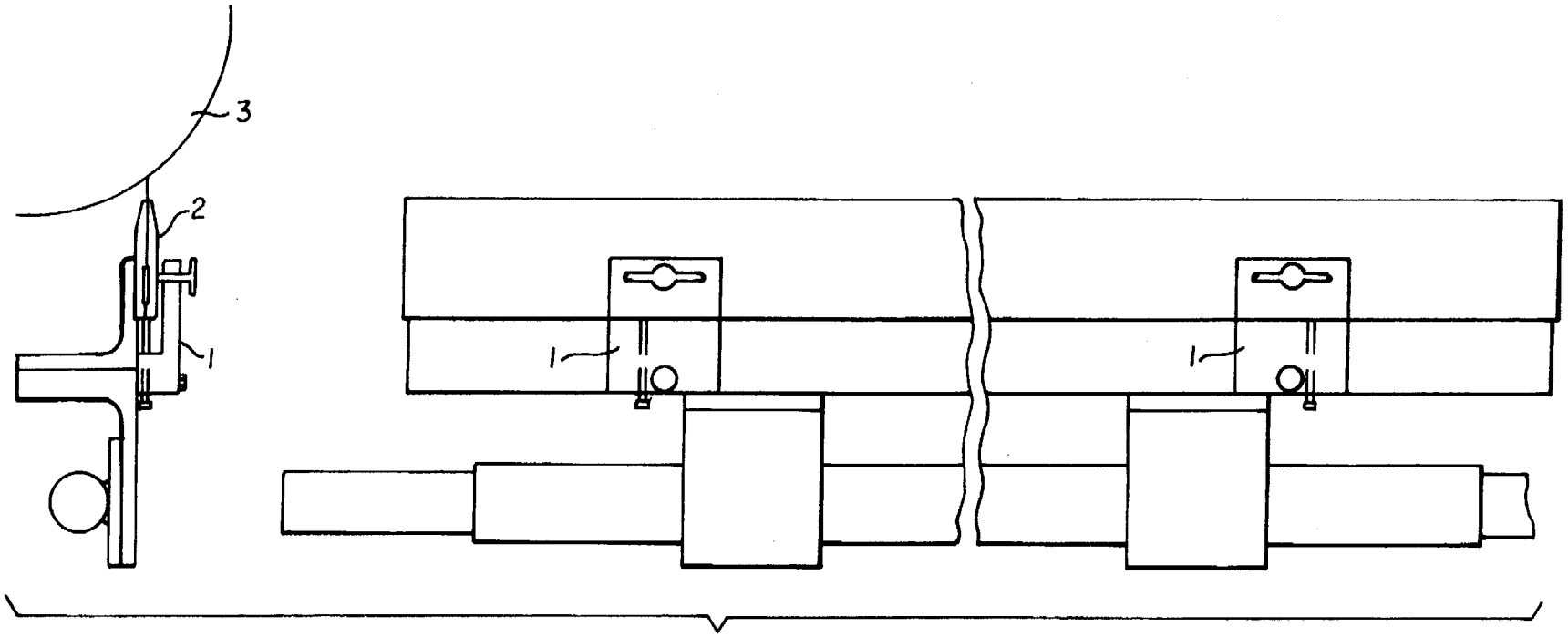
FIG. 1 (prior art)
FIG. 1 is a prior art blade secured showing independent adjusting and securing means.
Figure 2:
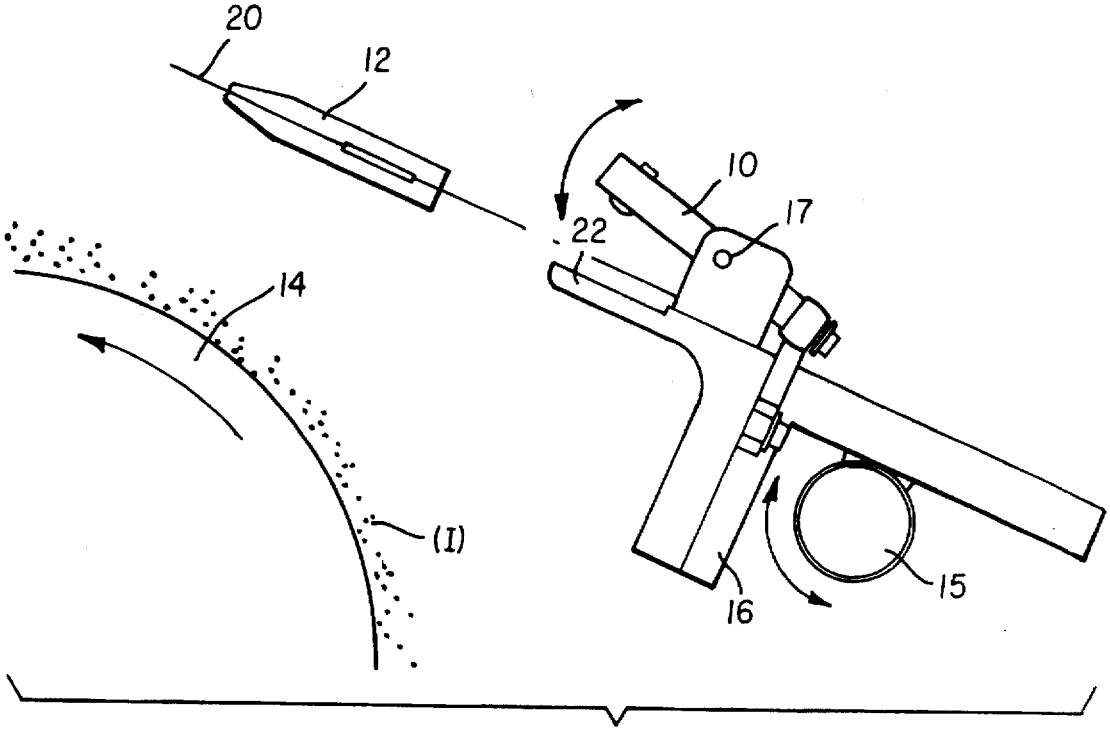
FIG. 2 is an exploded side elevational view showing a single clamp of the invention.
Figure 3:
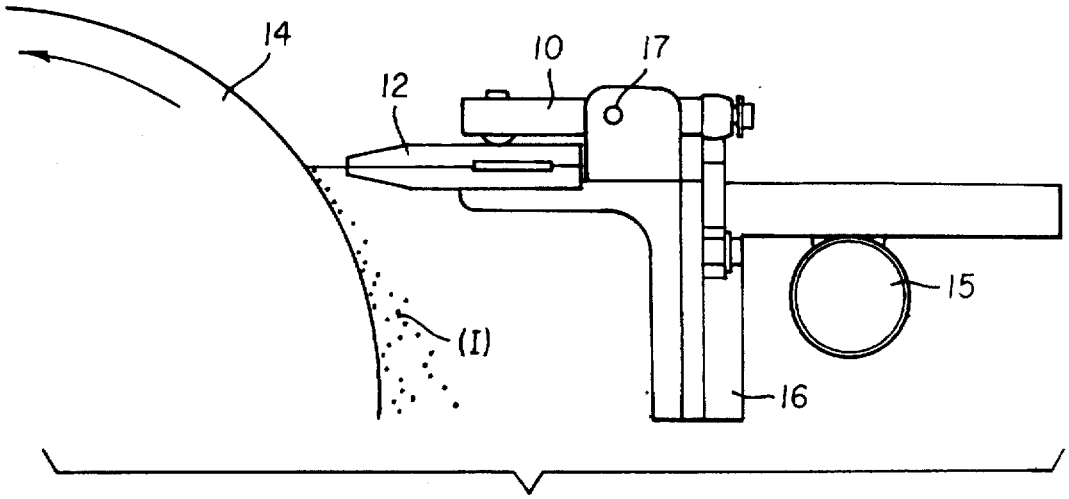
FIG. 3 is a side elevation view of the apparatus showing the clamped blade in contact with a print roller.
Figure 4:
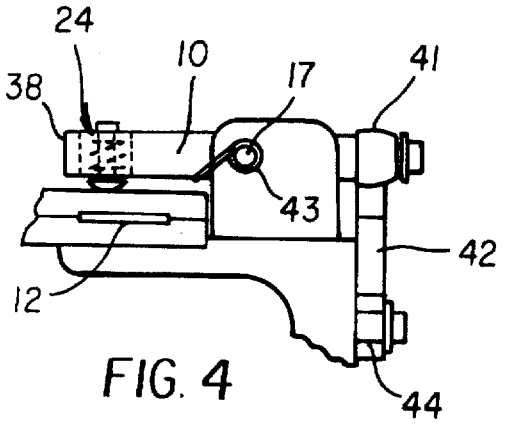
FIG. 4 is a side elevational view of the apparatus.
Figure 5:
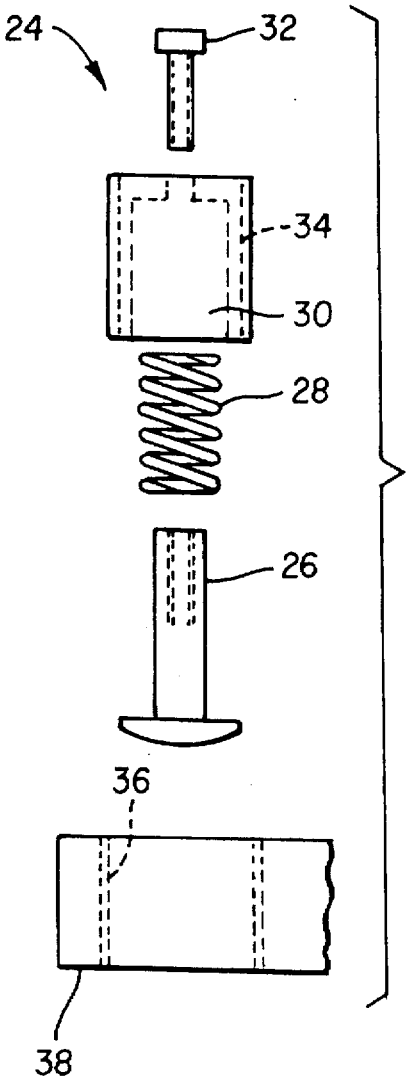
FIG. 5 an enlarged exploded view of the spring member shown in FIG. 4.

Turning now to the drawings, and more particularly to FIGS. 2 & 3, the apparatus 10 in accordance with the principles of the invention is illustrated. Broadly defined, apparatus, or clamp member, 10, for firmly securing a first, stationary surface, or doctor blade, 12, in proximate contact with a second, moving surface, 14, comprises a frame 16 for supporting the first surface 12 between clamp member 10 and frame 16. Frame 16 is configured to pivot about shaft 15 mounted in the printing machine frame (not shown). In this embodiment, first surface, or doctor blade, 12, is used to remove residual material, such as ink, (I), from the second surface, for example a print roller 14. Second surface 14 may be a rotating generally cylindrical roller, although a driven belt is within the contemplation of the invention.

In FIGS. 2–5, frame 16 for receiving and firmly holding at least a portion of the first surface 12 in cooperation with clamp member 10 so as to expose a lateral edge 20 thereof. In this arrangement, first surface 12 is supported on frame support surface 22. Apparatus, or clamp member, 10, is arranged so as to exert a constant compression force substantially along a portion of the first surface, or doctor blade, 12 thereby sandwiching the blade 12 firmly between the support surface 22 of the frame 16 and the clamp member 10, as best seen in FIGS. 2 & 3. Clamp member 10 is pivotably connected to frame 16 by pin 17 which passes through an opening (not shown) in the frame 16 and clamp member 10 and is secured therein. In a preferred embodiment, clamp 10 is made of preferably a metallic material, such as steel. Moreover, in FIGS. 4 & 5, clamp member 10 preferably comprises a biased member, preferably a spring assembly 24, for securely grasping a portion of the first surface 12. According to FIG. 5, spring assembly 24 comprises a floater pin 26 over which a helical spring 28 or alternately a plurality of spring washers (not shown) can be arranged about the floater pin 26. Those skilled in the art will appreciate that other bias members may also be used in stead of the helical spring 28, such as a plurality of spring washers which we prefer. The pin 26 with the spring 28 is then inserted into a tubular shaped cap-like member 30 and secured by a screw 32. The cap-like member 30 comprising a threaded outside diameter portion 34 is then threaded into a treaded opening 36 in an end portion 38 of the clamp 10. At this point, pin 26, having a head portion 27, is extended through the threaded opening 36 of the clamp 10 until the head portion 27 is positioned to make contact with the first surface 12. The extension of pin 26 through the opening 36 determines the amount of compressive force which the head portion 27 applies on the first surface 12. Proper spring 28 design insures that the total spring deflection will produce the minimum holding force needed. This, we believe, is an important aspect of the invention since the spring 28 enables the clamp 10 to exert consistent and uniform pressure on the first surface 12 even when the the first surface 12 is replaced to account for variations in the precise position of the first surface 12.

Figure 6:
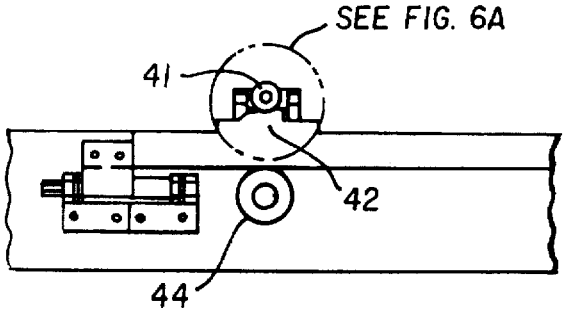
FIG. 6 is a rear elevation view of the apparatus showing an enlarged exploded view of the cam; and, FIG. 7 is a top plan view of the apparatus.
Figure 6A:
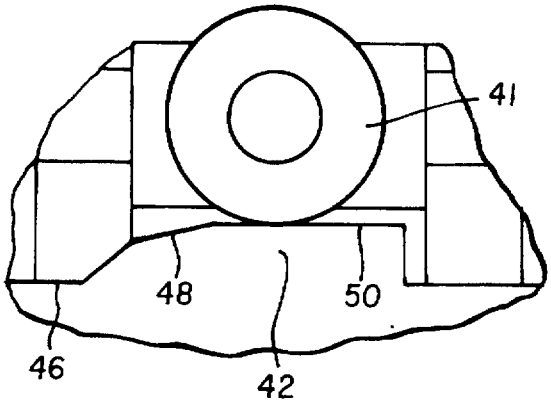

According to FIG. 6, means are provided for simultaneously and uniformly adjusting the position of a cam member as it rides among open, closed and intermediate positions, as decried below. More particularly, preferably a plate cam 42 for opening and then closing the clamp member 10 enables the clamp member to alternately receive and release a partial portion of the first surface 12. Those skilled in the art will appreciate that other types of cams can be used within the scope of the invention, including a rotary type cam (not shown). Clamp 10 is provided with a cam follower 41 which tracks the profile (as described below) of the cam 42 thereby imparting movement to the clamp member 10. Cam 42 is arranged to ride on a fixed surface, preferably a roller 44, to enable the cam 42 to move freely. By moving the cam 42 in a horizontal direction (shown by arrow bars), thus wedging the cam 42 between the clamp member 10 and the fixed roller 44, cause the clamp member 10 to move in a vertical direction (shown by arrow bar in FIG. 6). More particularly, means for opening and then closing the compressive means comprises an adjustable nut being fixed to the frame and a cooperating bolt assembly being fixed to the cam member. Rotating the bolt assembly in a first direction causes the cam member to impart movement to the clamp member thereby at least partially releasing the clamp member from the first surface. On the other hand, when the bolt is rotated in a second position, the cam member moves so as to cause to the clamp member to close upon the first surface. Thus, when clamp member 10 is in the open position to receive the first surface 12 in cooperation with the frame support surface 22, the cam follower 41 resides on the first plateau 46 of the cam 42. To ensure that the cam follower 41 remains in intimate contact with the cam 42, a torsional spring 43 (shown in FIG. 4) is provided on pin 17 to retain at least a partially biased relationship between clamp member 10 and cam 42. Further, when the clamp member 10 is in an intermediate position the cam follower 41 is at the second plateau 48 of cam 42. In this position, the biased pressure exerted by the clamp member 10 on the first surface 12 is partially reduced to enable adjustment of the first surface 12. Furthermore, when the clamp member 10 is exerting maximum compressive force on the first surface 12, the cam follower 41 is at the third plateau 50 of cam 42. In this position, the clamp member is in the closed position about the first surface 12.

Figure 7:
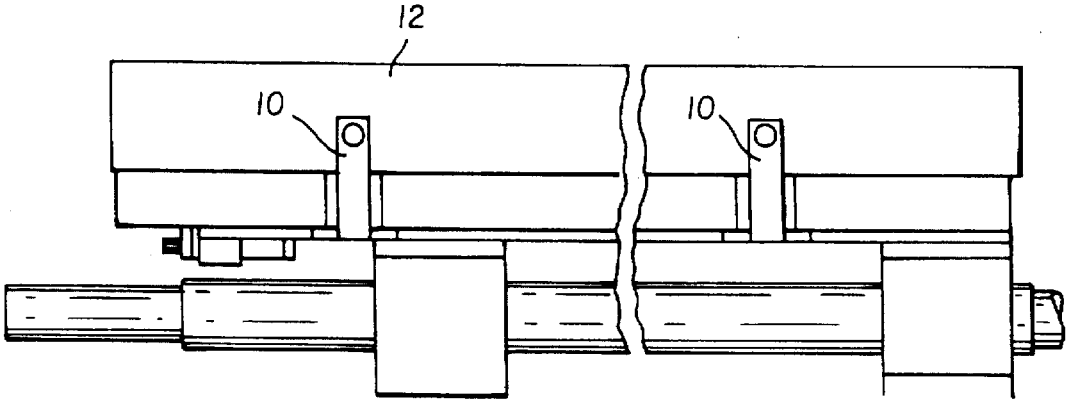

In FIG. 7, in an alternative embodiment of the invention, a plurality of clamps 10, as described above, may be utilized to effectively secure and release simultaneously the doctor blade 12 depending on the length of the blade 12. The clamps can open and close simultaneously by manipulating the cam in communications with each of the clamp members so that movement of the cam is imparted instantaneously to all clamp members.

In another embodiment of the invention, a method of firmly securing and aligning a first, fixed surface, 12, in proximate contact with a second, moving surface, 14, comprises the steps of providing the first surface, such as a doctor blade 12, each as described above. Further, means, preferably a clamp 10 are provided for compressively holding the first surface 12 in alignment with the second surface 14, as discussed above. Furthermore, compressively engaging at least a portion of the first surface 12 so as to expose a lateral edge 20 thereof. The engaging means further secures the location of the first surface 12 in relations to the second surface 14.

Parts List (I) . . . print ink 10 . . . apparatus or clamp member 12 . . . first surface, or doctor blade 14 . . . second surface or print roller 16 . . . frame 17 . . . pivot pin 20 . . . lateral edge of doctor blade 22 . . . frame support surface 24 . . . spring assembly 26 . . . floater pin 28 . . . spring 30 . . . cap-like member 32 . . . screw 34 . . . threaded diameter portion of cap-like member 36 . . . threaded opening in clamp 38 . . . end portion of clamp 41 . . . cam follower 42 . . . cam 44 . . . fixed roller 46 . . . first plateau of cam 48 . . . second plateau of cam 50 . . . third plateau of cam While the invention has been shown and described with reference to particular embodiments thereof, those skilled in the art will understand that other variations in form and detail may be made without departing from the scope and spirit of the invention.

We claim:

1. An apparatus for precisely locating and securing a first, stationary surface in proximate rotating contact with a second, moving surface, comprising:

a frame for supporting the first surface;

means associated with said frame for compressively holding at least a portion of said first surface so as to expose a lateral edge portion thereof, said means exerting a constant uniform force substantially lengthwise along an outward face of said at least portion;

said means for holding comprising at least one clamp member pivotably connected to said frame for adjustably holding said first surface stationary against said frame and aligned continuously with said second surface, said clamp member being adapted to alternately receive and release said first surface; and, a cam member having successively elevated first, second and third plateaus arranged thereon and a cooperating cam follower mounted for movement among said first, second and third plateaus thereby adjustably urging the clamp member to selectively receive and release the first surface.

2. The apparatus recited in claim 1 wherein the clamp member is spring biased against the frame.

3. The apparatus recited in claim 1 wherein said means for compressively holding further comprises an adjustable spring member for exerting pressure uniformly along the first surface.

4. The apparatus recited in claim 1 wherein said at least one clamp member is connected to said frame by a pivot pin.

5. The apparatus recited in claim 1 wherein the first surface abuts against an enclosed wall formed by the clamp and frame.

6. The apparatus recited in claim 1 wherein the second surface is a rotatable roller.

7. The apparatus recited in claim 6 wherein said first surface is a metallic material having an extendable flexible lateral edge portion for contacting the rotatable roller.

8. The apparatus recited in claim 1 wherein said holding means comprises an adjustable nut and bolt assembly, said bolt being fixed to said cam member and said nut being fixed to said frame so that when said bolt is rotated in a first direction, the cam member imparts movement to the clamp member thereby at least partially releasing the clamp member from the first surface, and wherein when said bolt is rotated in a second position, the cam member moves so as to cause to the clamp member to close upon the first surface.

9. The apparatus recited in claim 1 wherein said cam follower is a bearing roller arranged between said cam member and said frame, said bearing roller providing support for said cam member.

* * * * *

UNITED STATES PATENT AND TRADEMARK OFFICE

CERTIFICATE OF CORRECTION

PATENT NO. :5,740,735
DATED :April 21, 1998
INVENTOR(S) :Jean Xydias et al

It is certified that error appears in the above-identified patent and that said Letters Patent is hereby corrected as shown below:

Title page, insert the following item:

-- [60] Provisional application No. 60/006,667, filed October 31, 1995--.

Column 1, line 2, insert the following:
-- Cross Reference To Related Application Reference is made to and priority claimed from U.S. provisional application Ser. No. 60/006,667, filed October 31, 1995, entitled Apparatus For Securing A Surface--

Signed and Sealed this

Seventeenth Day of November, 1998

*Attest:*

Bruce Lehman

BRUCE LEHMAN

*Attesting Officer*

*Commissioner of Patents and Trademarks*